United States Patent [19]

Quayle

[11] 4,097,165

[45] Jun. 27, 1978

[54] POLE TOP EXTENSION BRACKET

[76] Inventor: Jackson C. Quayle, 10225 Darrow Rd., Twinsburg, Ohio 44087

[21] Appl. No.: 792,130

[22] Filed: Apr. 29, 1977

Related U.S. Application Data

[63] Continuation-in-part of Ser. No. 680,290, Apr. 26, 1976, Pat. No. 4,032,244.

[51] Int. Cl.[2] ..... F16B 7/00

[52] U.S. Cl. ..... 403/286; 403/11; 403/312; 52/514; 52/726; 52/296

[58] Field of Search ..... 403/300, 301, 306, 309, 403/312, 286, 293, 11; 52/726, 514, 295, 296, 297, 298; 61/53

[56] References Cited

U.S. PATENT DOCUMENTS

| | | | |
|---|---|---|---|
| 1,073,614 | 9/1913 | McDearmid | 61/53 |
| 1,420,430 | 6/1922 | Jaeckle et al. | 403/312 |
| 2,222,481 | 11/1940 | Ferguson et al. | 61/53 X |
| 2,679,911 | 6/1954 | Bhend | 52/298 |
| 2,822,014 | 2/1958 | Cummaro | 151/41.73 |
| 3,201,834 | 8/1965 | Baittinger | 403/312 |
| 3,295,275 | 1/1967 | Carlsen | 52/296 X |
| 3,461,772 | 8/1969 | Barry | 85/21 X |
| 3,720,068 | 3/1973 | DeRosa | 61/53 |
| 3,802,206 | 4/1974 | Moore | 61/53 |
| 4,048,779 | 9/1977 | Valenziano et al. | 52/726 |

FOREIGN PATENT DOCUMENTS

| | | | |
|---|---|---|---|
| 2,116,538 | 2/1973 | Germany | 52/726 |
| 1,268,995 | 3/1972 | United Kingdom | 52/726 |

*Primary Examiner*—Wayne L. Shedd
*Attorney, Agent, or Firm*—Meyer, Tilberry & Body

[57] ABSTRACT

An extension for a wooden utility pole is provided in which a novel bracket is secured to the flattened top of an existing pole. A projecting center shaft extends from the bracket to be received within matching center bores provided in the utility pole, a wooden extension pole or both. Threaded fasteners and metal straps complete the interconnection between the existing pole and the extension pole.

8 Claims, 9 Drawing Figures

FIG. 2
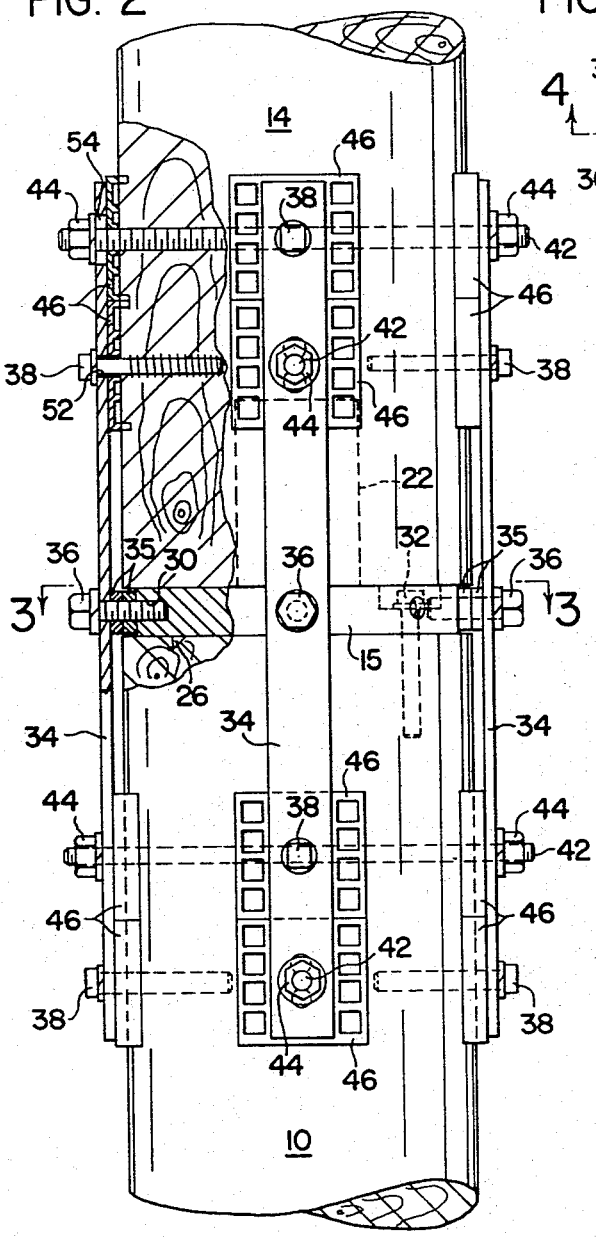
FIG. 3
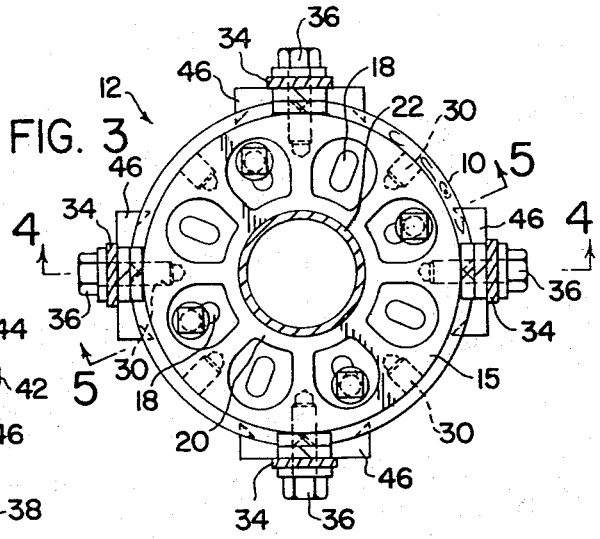
FIG. 4
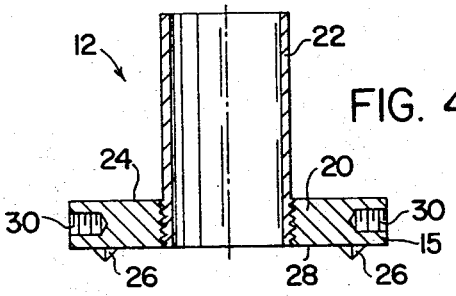
FIG. 5
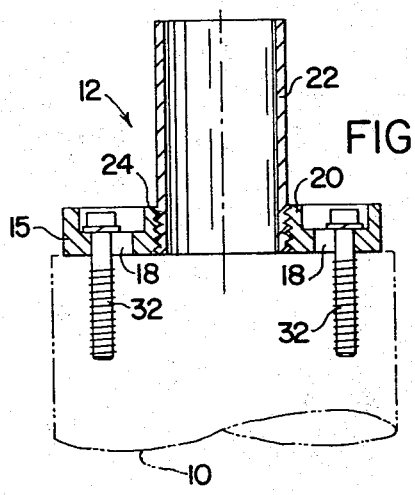
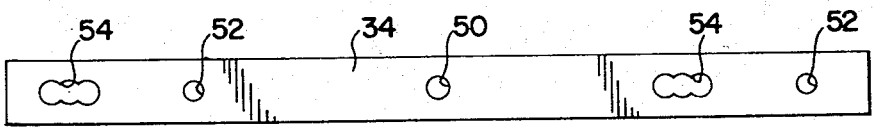
FIG. 6

POLE TOP EXTENSION BRACKET

This application is a continuation-in-part of copending application Ser. No. 680,290 filed Apr. 26, 1976 now U.S. Pat. No. 4,032,244.

This invention relates to a bracket for extending the height of wooden utility poles in lieu of replacing old shorter poles with new longer poles when conductor or cable requirements change, or for any other reason.

It is an object therefore of this invention to provide a means for extending the height of existing utility poles which is inexpensive, simple in concept, and easy to apply to existing poles. Other objects of this invention will become apparent from a reading of the disclosure taken into conjunction with the Figures and claims.

In the figures:

FIG. 2 is a fragmentary view in elevation of a preferred embodiment of the invention as applied to a utility pole;

FIG. 3 is a plan view of the invention taken along the line 3—3 of FIG. 2;

FIG. 4 is a fragmentary sectional elevational view of the invention taken along the line 4—4 of FIG. 3;

FIG. 5 is a fragmentary sectional elevational view of the invention taken along the line 5—5 of FIG. 3;

FIG. 6 is a plan view of a strap used in conjunction with the invention;

Figure 1:
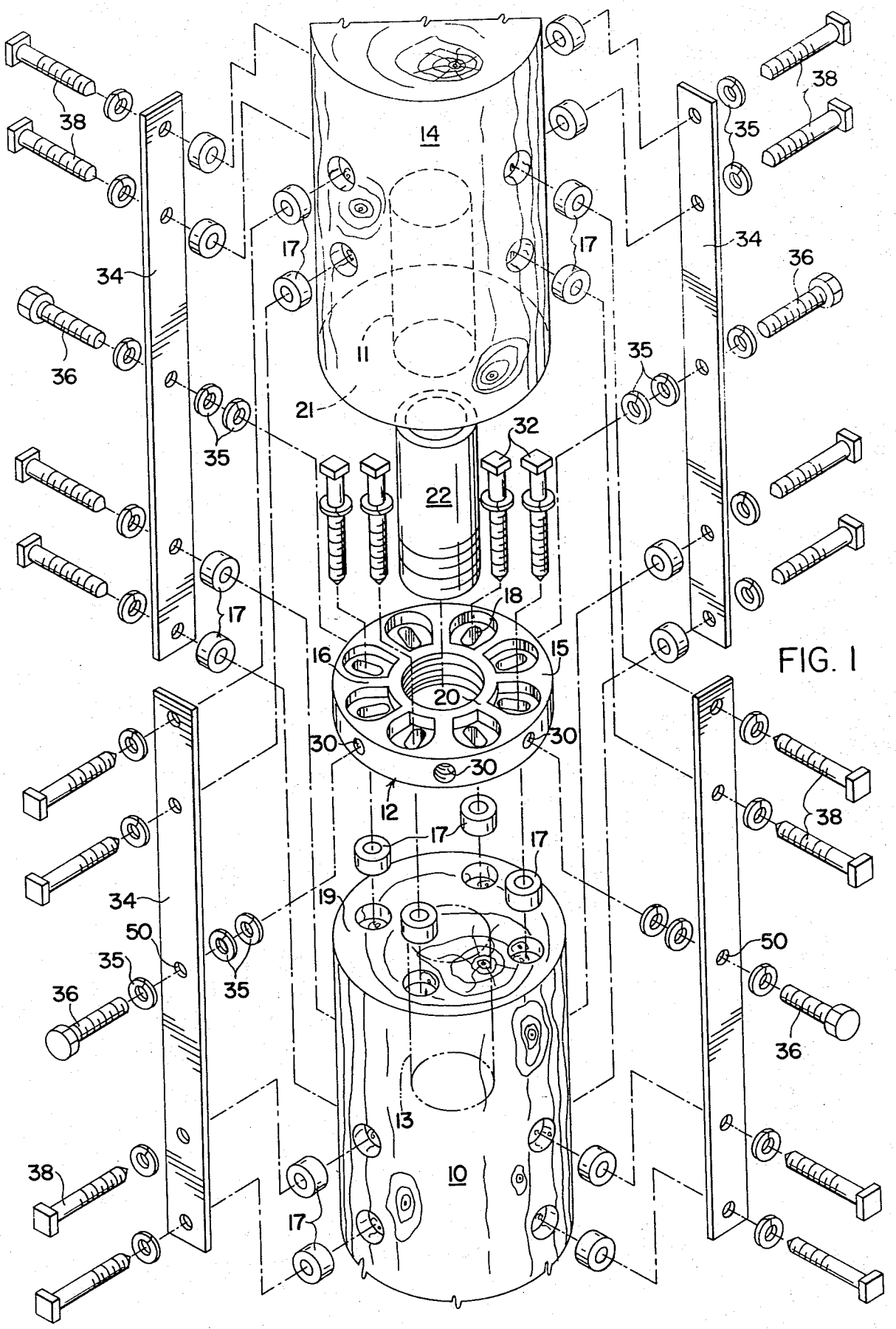
FIG. 1 is an exploded isometric view of a preferred embodiment of the invention illustrating the assembly thereof.

Referring now to the Figures in greater detail, and in particular to FIGS. 1 and 2, an existing utility pole 10 has secured to its top surface a pole top extension bracket 12 to which is also secured pole top extension member 14.

Referring to FIGS. 1 and 3, it will be seen that the pole top extension bracket 12 comprises a circular plate 15 which is provided with a plurality of substantially radially aligned reinforcing ribs 16. Between each pair of ribs is a radially elongated aperture 18. While a circular plate is preferred, it will be understood that the plate may be of any shape which substantially conforms to the cross-sectional shape of the pole top. At the center of the plate 15 the ribs 16 join to form a hub 20. Extending outwardly from hub 20 is a shaft 22, better shown in FIGS. 4 and 5, extending normally from the top face 24 of the plate 15. As shown in the Figures, the shaft 22 is preferably hollow to allow for storage of wood preservative materials which protect the pole from decay where decay conditions exist. It will be understood, however, that the shaft 22 may also be of a solid construction. FIGS. 1, 4 and 5 also show hub 20 and shaft 22 as being threaded for securing the shaft 22 to plate 15. As shown, this means of attachment of the shaft 22 to the plate 15 is only a preferred embodiment and other means for incorporating shaft 22 into the bracket 12 are contemplated within the scope of the invention such as by welding shaft 22 in place or casting the entire bracket including plate 15 and shaft 22 in one piece.

Also best shown in FIG. 4 are the teeth members 26 which may be provided on either the upper face 24, or lower face 28 or both of plate 15 to provide a good gripping contact between the upper flat surface of the existing pole and the lower flat surface of the pole top extension. Also as best shown in FIG. 4, are the holes 30 tapped to receive threaded strap fasteners such as machine bolts therein, as will be described more fully hereinbelow.

Referring to FIG. 5, it will be seen that the elongated radial holes 18 are adapted to receive lag screws 32 therethrough into the top face of the existing pole 10. The pole top extension 14 is center bored to receive shaft 22 therein to anchor pole top extension 14 to plate 15.

After the pole top extension 14 has been secured to plate 15 and positioned concentric with existing pole 10 on the top face of pole 10, pole straps 34 are bolted to the periphery of plate 15 with threaded strap fasteners such as machine bolts 36 passing through apertures 50 in straps 34. Although apertures 50 are shown in the Figures to be circular in form, they may alternatively be in the form of slots extending transversely of the longitudinal axis of straps 34 so as to accommodate possible horizontal deviations in the mounting of the straps 34 on the pole members. The upper and lower portions of straps 34 are provided with a special alternating arrangement of serrated slots 54 which in combination with holes 52, as shown in FIGS. 1 and 6, to receive transverse bolts 42, or lag screws 38, respectively, as shown in FIGS. 1 and 2, thereby anchoring pole top extension 14 securely to existing pole 10. The serrated slots 54 and holes 52 in straps 34 are alternated so that identical straps may be used in a plane 90° from the plane of another set of straps and bolts when used in inverted position and there will be no interference from crossing transverse bolts 42, their position being in an above and below relationship. The elongated serrated slots 54 in straps 34 are to allow for deviation of the bolts through the pole from a horizontal plane. Transverse bolts 42 are secured with nuts 44 following insertion through the pole and straps. It will be understood that in place of transverse bolts 42, additional lag bolts such as bolts 38 may be utilized to effect the attachment of straps 34 to the existing pole 10 and the pole top extension 14.

In order to accommodate existing poles of greater diameter than plate 15, washers 35 may be placed over machine bolts 36 between plate 15 and pole straps 34 until the pole straps make planar contact through washers 35 along the periphery of the plate 15 and the longitudinal surface of the existing pole 10 and the pole top extension 14 as shown best in FIG. 1. Also, to accommodate existing poles with a diameter less than that of the plate 15 washers 35 may be placed on lag screws 38 and the transverse bolts 42 at a point between straps 34 and the timber connectors 46.

The plate 15 may be cast from ferrous or non-ferrous metal depending on the strength requirements of the particular pole top extension installation. The straps 34 may be ferrous or non-ferrous metal depending also on strength requirements.

It should be understood that while the embodiment above-described teaches the attachment of plate 15 to existing pole 10 with shaft 22 passing into pole top center bore 11 of extension 14, a reverse arrangement of the plate 15 attached to pole top extension 14 with shaft 22 extending into a center bore 13 in existing pole 10 is also possible and included within the scope of the present invention.

Figure 7:
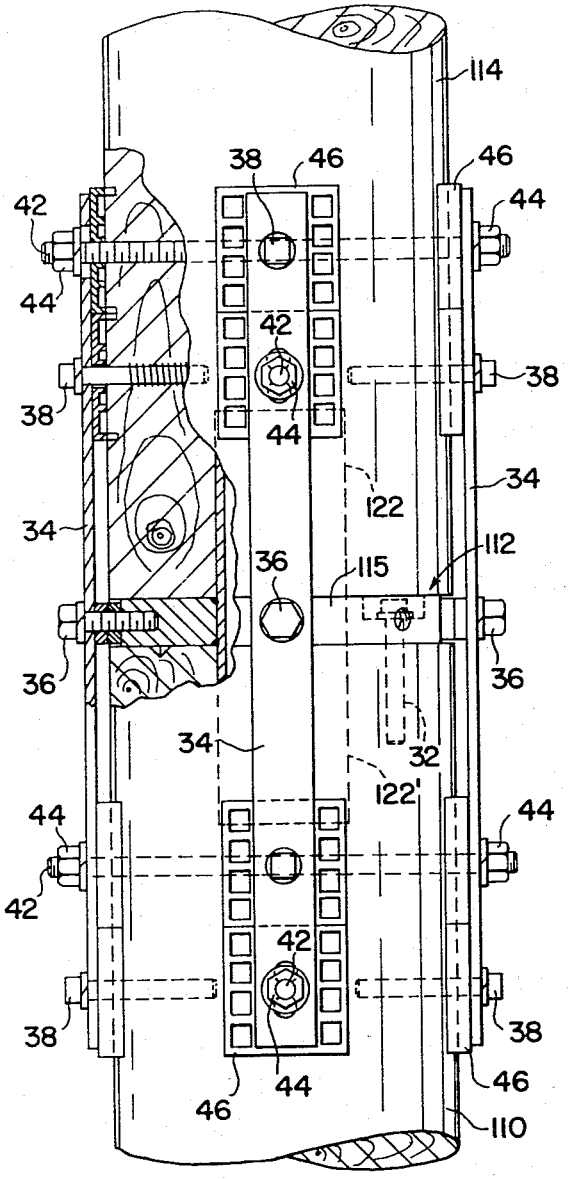
FIG. 7 is a fragmentary view in elevation of another embodiment of the present invention.

FIG. 7 illustrates an alternate embodiment of the invention in which both existing pole 110 and extension member 114 are centerbored to receive coaxial shafts 122' and 122 respectively. It will be understood that shafts 122 and 122' may be made in one piece extending through the plate 115 or may be two separate pieces. The central shaft may be attached by the various means previously described such as by welding or by casting or, in the case of a single piece shaft, the shaft may be merely slip-fit through the plate member. Except for the addition of downwardly extending shaft 122', the remaining structure of the bracket is similar to that shown in FIG. 1.

Figure 8:
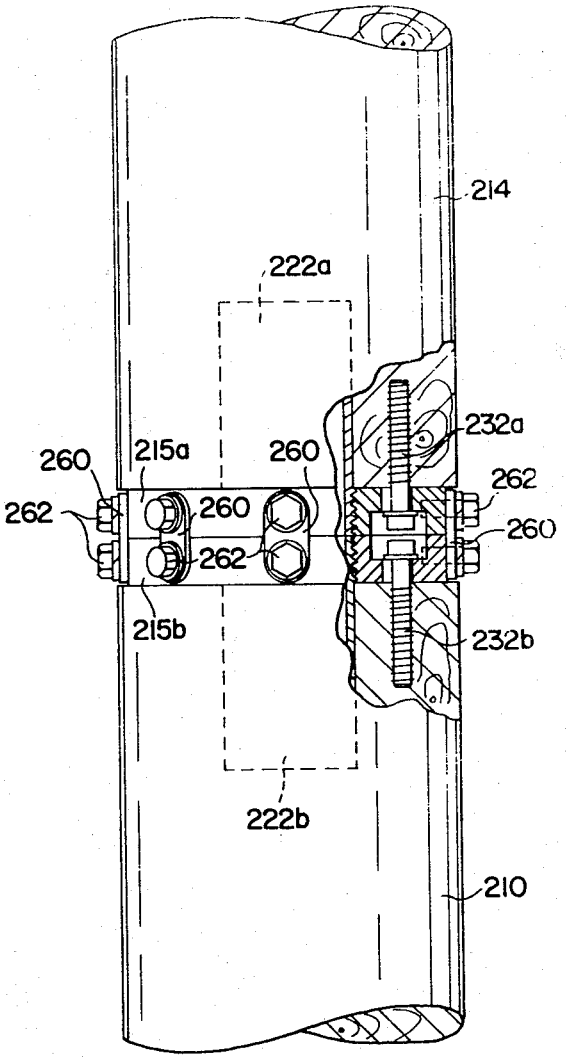
FIG. 8 is a fragmentary view in elevation of yet another embodiment in accordance with the invention; and, FIG. 9 is an exploded isometric view of still another preferred embodiment in accordance with the invention.

FIG. 8 illustrates a further embodiment of the invention in which two plate members **215*a* and 215*b* are provided which are attached respectively to the pole top extension 214 and the existing pole 210 by means of lag bolts 232*a* and 232*b* respectively in a manner such as previously described. Plate member 215*a* is provided with coaxial upwardly extending shaft 222*a* which is received in a center bore provided in the pole top extension. Plate member 215*b* is provided with coaxial downwardly extending shaft 222*b* which is received in a center bore provided in existing pole 210**.

In order to secure plate **215*a* to plate 215*b*, plate strap members 260 are provided which attach to plates 215*a* and 215*b* by threaded plate strap fasteners 262** passing therethrough.

Finally, referring to FIG. 9, a preferred embodiment of the invention is illustrated wherein the threaded fasteners 38 are more firmly secured in the pole members 10 and 14 in applications where severe bending stresses are anticipated. Sleeves 17 are embedded in the sides of post members 10 and 14 in concentric alignment with apertures 50 of straps 34 to provide non-yieldable bearing surfaces between the shanks of the threaded fasteners 38 and the post members. With this arrangement, if there is a tendency for the threaded fasteners to tear loose when the assembled post members 10 and 14 are stressed in bending, the sleeves 17 enable the fasteners 38 to resist much higher stress loadings. In like manner, by embedding sleeves 17A in the top cross-sectional surface 19 of post member 10, the capacity of threaded fasteners 32 to resist shear stresses is considerably enhanced. Sleeves 17 and 17A may be made of ferrous metal, plastic or hardened rubber. It will be understood by those skilled in the art that sleeves 17A may, in the alternative, be embedded in the bottom cross-sectional under surface 21 of post member 14, wherein threaded fasteners 32 would then be used to secure plate 15 to under surface 21 of post member 14. Whereupon, shaft 22 would be inserted in center bore 13 of post member 10. Otherwise stated, a reversal of parts 15, 22 and accessories 17A and 32 with respect to post members 10 and 14 is contemplated as being within the scope of the invention.

With the employment of sleeves 17 in post members 10 and 14 it has been found that transverse bolts 42 and timber connectors 46 need not be used. With the elimination of transverse bolts 42, serrated slots 54 may also be dispensed with because threaded fasteners 36 do not present the strap aperture alignment problems encountered with transverse bolts.

Whereas certain preferred embodiments of my invention have been described herein, it is understood that other modifications within the scope of my invention will occur to those skilled in the art upon reading the foregoing disclosure. It is intended therefore that this invention only be limited by the scope of the claims set forth hereinbelow.

The invention having thus been described, it is claimed:

1. A bracket for connecting a top extension pole member to an existing pole member each having an end portion comprising: a metal plate having parallel planar surfaces and a centrally located shaft member extending perpendicularly outwardly therefrom to be received in at least one corresponding center bore provided in one of said pole members; apertures provided through said plate; first sleeves matingly embedded in the end portion of the existing pole member concentrically aligned with said apertures; relatively large fastening means passing through said apertures and through said sleeves into the top of said existing pole to attach and hold said metal plate thereon; strap members positioned vertically along the outer surfaces of said pole members and said plate with apertures therein; second sleeves matingly embedded in said outer surfaces of said pole members concentrically aligned with said strap apertures; fastening means to secure said straps to the periphery of said plate; and fastening means passing through said strap apertures and said second sleeves into said pole members to secure said strap members to said pole members to form a unified pole structure capable of resisting significant shear and bending moment stresses.

2. The device as described in claim 1, wherein said fastening means securing said straps to said pole members are threaded fasteners.

3. The device as described in claim 1, wherein the periphery of said plate is provided with threaded holes adapted to receive threaded fasteners; and said fastening means to secure said straps to said plate are threaded fasteners.

4. The device as described in claim 1, wherein said shaft member extends upwardly into said top extension pole member.

5. The device as described in claim 1, wherein said shaft member extends downwardly into said existing pole member.

6. The device as described in claim 1, wherein said sleeves are metal.

7. The device as described in claim 1, wherein said sleeves are plastic.

8. The device as described in claim 1, wherein said sleeves are hardened rubber.

* * * * *